US005154527A

United States Patent [19]

Blessing

[11] Patent Number: 5,154,527

[45] Date of Patent: Oct. 13, 1992

[54] BRACKET FOR SUPPORTING BINDERS IN A HANGING FILE

[76] Inventor: Gary E. Blessing, 4853 Marydale Cir., Lilburn, Ga. 30247

[21] Appl. No.: 833,094

[22] Filed: Feb. 10, 1992

[51] Int. Cl.[5] ..... B42F 7/00; B42F 13/40; B42F 15/00

[52] U.S. Cl. ..... 402/4; 402/80 R; 312/184

[58] Field of Search ..... 211/45; 312/184; 402/80 R

[56] References Cited

U.S. PATENT DOCUMENTS

| | | | |
|---|---|---|---|
| 3,801,175 | 4/1974 | Giulle | 402/4 X |
| 3,936,201 | 2/1976 | Kenney et al. | 402/4 |
| 4,208,146 | 6/1980 | Schudy | 402/80 R X |
| 4,395,058 | 7/1983 | Terrell | 402/4 X |
| 4,950,096 | 8/1990 | Gilder | 402/80 R X |
| 4,979,626 | 12/1990 | Pitts | 402/4 X |

*Primary Examiner*—Paul A. Bell
*Attorney, Agent, or Firm*—Hurt, Richardson, Garner, Todd & Cadenhead

[57] ABSTRACT

A device for supporting a ring binder vertically within a hanging file system of the type having laterally extending support rails, the device being suitable for use with conventional ring binders of the type having a spine and a ring mechanism secured to the spine by two or more fasteners. The device includes a thin, U-shaped support bracket adapted to be removably inserted between the spine of the ring binder and the ring mechanism of the ring binder. The U-shaped support bracket has a medial portion, a hook-like portion, and first and second elongate arms extending from the medial portion. The first and second elongate arms are spaced apart from one another and define an opening therebetween which is sized and adapted to receive therein one of the fasteners of the ring binder.

9 Claims, 2 Drawing Sheets

BRACKET FOR SUPPORTING BINDERS IN A HANGING FILE

TECHNICAL FIELD

The present invention generally relates to ring binders and hanging files, and more particularly relates to a device for supporting ring binders in hanging files.

BACKGROUND OF THE INVENTION

One popular form of filing system in wide use today is the so-called "hanging file" in which two parallel support rails are positioned within a file drawer and extend laterally therein. File folders with hooks positioned at their upper outside ends are placed within the file drawer and hang (are suspended) by the hooks resting upon the support rails.

While this system has many advantages, it is not readily suitable for storing ring binders. Conventional ring binders have a book-like construction with a spine hingedly attached to front and back covers and a ring mechanism mounted to the spine by rivets or other fasteners. It is possible, during the manufacture of the ring binders, to make the ring binder capable of being suspended in the hanging file system by providing outwardly extending hooks for resting atop the lateral support rails of the hanging file system. However, this is inapplicable to the problem of placing existing, conventional ring binders in a hanging file. Furthermore, it is important that the ring binder, once removed from the hanging file, be capable of being quickly converted to its ordinary configuration in which it does not have hooks extending from the ends of the spine. This is so because such outwardly extending hooks tend to mar surfaces with which the hooks come in contact and in general the hooks tend to get in the way and look clumsy.

U.S. Pat. No. 3,936,201 of Kenney relates to a hanger for ring binders which is capable of being used with existing, conventional ring binders. The hanger disclosed therein has an elongate member with a length greater than the length of the spine of the ring binder, with hooks provided on the ends of the elongate member. The elongate member also has a number of slots to allow the member to be slipped over the rings of the ring binder. The slots have a length sufficient to allow the elongate member to slide along the length of the spine to allow the ring binder to stand on end without having the lowermost hook interfere with the supporting surface upon which the ring binder is standing. Such a device generally suffers however from requiring that to be used with existing ring binders already having material placed therein, the rings of the ring binder must be opened up to place the elongate member on the rings, thereby providing an opportunity for losing papers or replacing papers out of sequence.

U.S. Pat. No. 4,208,146 of Schudy relates to a suspension device for ring binders and discloses a device which is formed of an angled strip having slides which can be pulled out so as to project from opposite ends of the spine to suspend the binder. The device is adapted to fit on the rings of the ring mechanism of the binder and acts to support the rings for supporting the binder. Schudy also suffers from the same general shortcoming of devices according to Kenney, et al. namely that in order to mount and dismount the device of Schudy to a ring binder, one must open and close the rings.

Accordingly, it can be seen that a need yet remains for a device for supporting ring binders in a hanging file, which device is capable of being mounted to existing, conventional ring binders without requiring that the rings of the ring binder be opened therefor. It is to the provision of such a device that the present invention is primarily directed.

SUMMARY OF THE INVENTION

Briefly described, in a preferred form the present invention comprises a device for supporting a ring binder vertically within a hanging file system of the type having laterally extending support rails. The device is suitable for use with conventional ring binders of the type having a spine and a ring mechanism secured to the spine by two or more fasteners. The device includes a thin, generally U-shaped support bracket which is adapted to be removably inserted between the spine of the ring binder and the ring mechanism of the ring binder. The U-shaped support bracket has a medial portion and first and second elongate arms extending from the medial portion. The first and second elongate arms are spaced apart from one another and define an opening therebetween which is sized and adapted to receive one of the fasteners therein. The medial portion of the support bracket is sized and adapted so that with the elongate arms inserted between the spine and the ring mechanism, the medial portion is positioned at least partly beyond an edge of the spine for resting atop one of the support rails of the filing system.

With this construction, a first one of these devices according to the present invention can be inserted between the spine and the ring mechanism at one end of the spine and a second device can be inserted between the spine and the ring mechanism at the opposite end of the spine. The ring binder then can be placed in a hanging file with the medial portions of the support brackets resting atop the support rails of the hanging file. The present invention thereby provides a ready and effective means for converting an ordinary ring binder for storage in a hanging file and for readily converting the ring binder back again when the ring binder is removed from the hanging file. This arrangement allows the ring binder to be converted without requiring that the rings first be opened, thereby helping to maintain the integrity of the contents of the ring binder. The device is quite compatible with existing, conventional ring binders.

Accordingly, it is a primary object of the present invention to provide a device for supporting a ring binder which is compatible with existing, conventional ring binders and which is effective for supporting such in a hanging file.

It is another object of the present invention to provide a device for supporting a ring binder in a hanging file which can be mounted to and removed from the ring binder without the necessity of opening the rings of the ring binder.

It is another object of the present invention to provide a device for supporting a ring binder in a hanging file, which device is easily and readily removably mounted to the ring binder.

It is yet a further object of the present invention to provide a device for supporting a ring binder in a hanging file which is durable in construction, economical in manufacture, and simple in use.

Other objects, advantages, and features of the present invention will become apparent upon reading the following specification in conjunction with the accompanying drawing figures.

BRIEF DESCRIPTION OF THE DRAWING FIGURES

DETAILED DESCRIPTION

Figure 1:
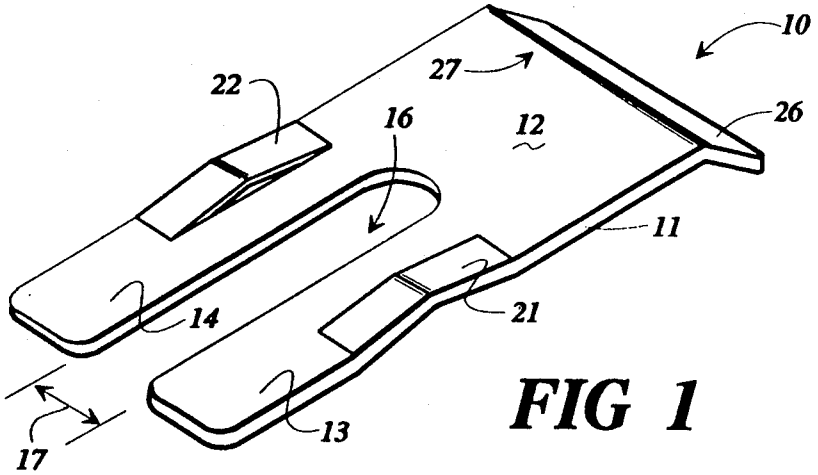
FIG. 1 is a perspective illustration of a device for supporting a ring binder within a hanging file in a preferred form of the present invention.
Figure 3:
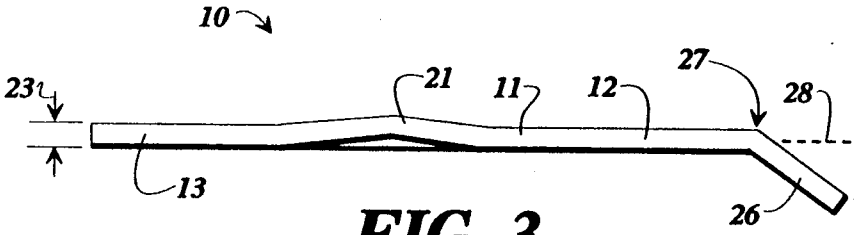
FIG. 3 is a side elevation view of the device of FIG. 1.
Figure 2:
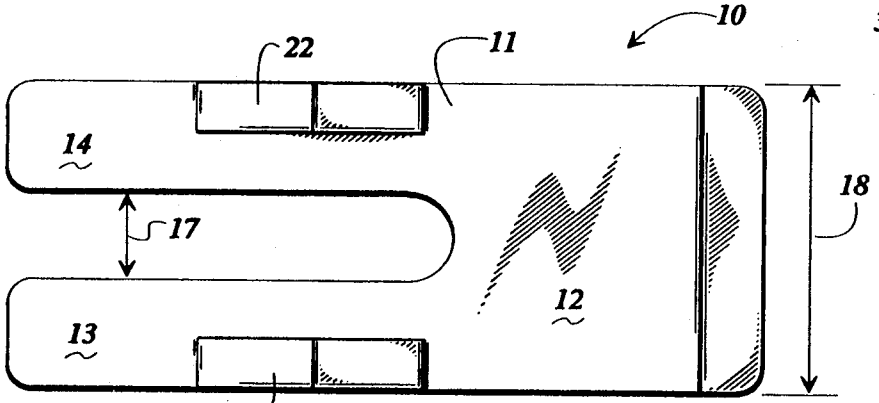
FIG. 2 is a plan view of the device of FIG. 1.

Referring now in detail to the drawing figures, wherein like reference numerals represent like parts throughout the several views, FIGS. 1–3 show a preferred form of a device 10 for supporting a ring binder vertically within a hanging file system. The device 10 is particularly adapted for supporting such ring binders of the type having a spine and a ring mechanism secured to the spine by two or more fasteners. The device 10 then allows, with the use of two such devices, the ring binder to be supported upon lateral support rails of the vertical filing system.

Device 10 is in the form of a generally U-shaped support bracket 11 which is adapted to be removably inserted between the spine of the ring binder and the ring mechanism of the ring binder. The U-shaped support bracket 11 includes a medial portion 12 of rectangular shape and first and second elongate arms 13, 14 adjoining and extending from the medial portion 12. The medial portion 12 and the elongate arms 13, 14 are all in a common plane. The elongate arms 13, 14 are in parallel, spaced apart relationship to one another and define therebetween an elongate slot or opening 16. The elongate slot 16 has a width 17 designed to accept therein the size of rivets, bolts, etc., typically found securing the spine to the ring mechanism in conventional ring binders.

The U-shaped support bracket 11 is made from a stamped piece of bright metal, such as stainless steel or plain steel which is chrome plated subsequent to the stamping operation. The U-shaped support bracket 11 has a width 18 sized for allowing the device 10 to be slipped between the spine and the ring mechanism of the ring binder. Of course, one can make devices having a width small enough to fit within most standard size ring binders by making the width 18 smaller than the width of the typically smallest ring binder (1 inch). On the other hand, one can make different size devices 10 having different widths 18 corresponding to the size of the ring binder in which it is to be mounted (e.g., 1 inch, 1½ inches, 2 inches, 3 inches, etc.).

The elongate arms 13, 14 carry thereon raised projections 21, 22. The purpose of the raised projections is to hold the device 10 in place when inserted between the ring mechanism and the spine of a ring binder. As shown, the raised projections can be made to have a width which is less than the width of each of the elongate support arms (in the embodiment depicted in the drawing figures, the width of the projections is approximately ½ the width of each of the elongate support arms). As shown in FIG. 3, the height of the projections 21, 22 above the elongate support arms 13, 14 ordinarily need only be on the order of several times the thickness 23 of the U-shaped support bracket 11.

An end portion 26 of the U-shaped support bracket 11 extends from a distal edge 27 of medial portion 12 and is oriented transversely of the plane 28 in which the medial portion 12 and the elongate arms 13, 14 lie. As depicted in the figures, the end portion 26 is oriented at a 45° angle, although other angles would work suitably well. Furthermore, while the end portion is shown as being generally planar, other configurations might be employed. The effect of the positioning and orientation of the end portion 26 is to create a somewhat hook-like structure which is useful for retaining the device upon a support rail of a hanging file system, as will be described in more detail below.

Figure 4:
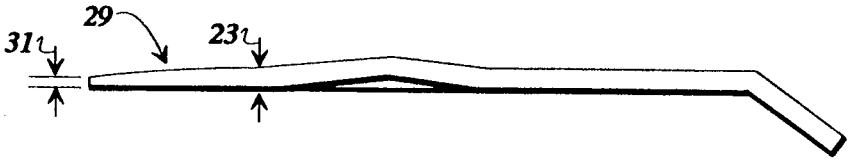
FIG. 4 is a side elevation view of a modified form of the device of FIG. 1.

FIG. 4 shows an alternative embodiment in which a leading end portion 29 of the elongate arms 13, 14 tapers from a thickness 23 generally adjacent the raised projections 21, 22 to a minimum thickness 31 at the tip of the elongate arms 13, 14. The taper of these elongate arms eases insertion of the elongate arms between the ring mechanism and the spine of the ring binder.

OPERATION

Figure 6:
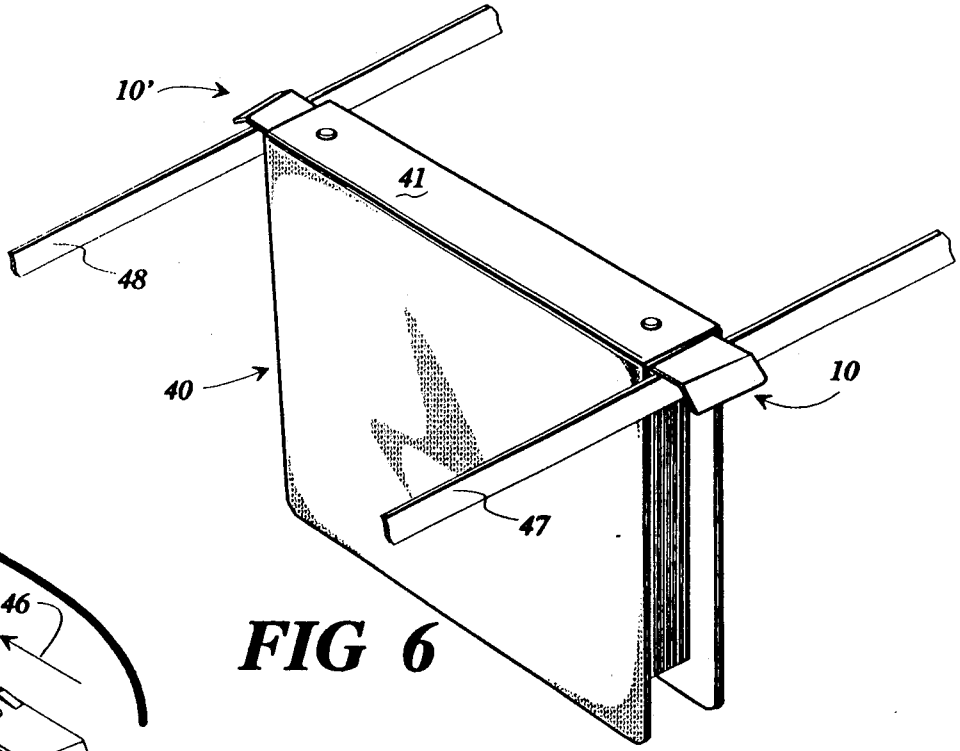
FIG. 6 is a perspective, schematic illustration of the devices of FIG. 5, shown mounted in a ring binder and supporting the ring binder upon support rails of a hanging file system.
Figure 7:
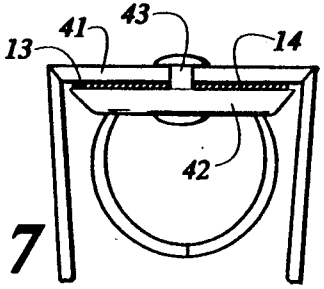
FIG. 7 is a side sectional view of one of the devices of FIG. 6, shown mounted in the ring binder.
Figure 5:
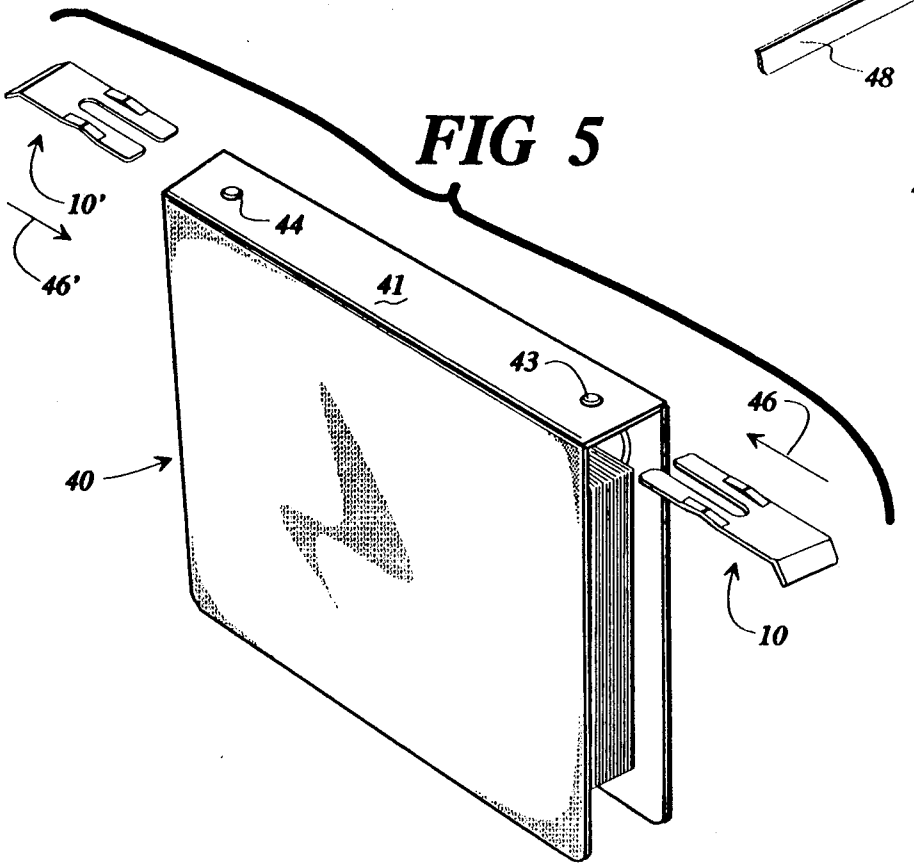
FIG. 5 is a schematic, partially exploded view showing how two of the devices of FIG. 1 are inserted into a ring binder.

Use of the devices according to the present invention is quite simple and straight-forward. As depicted in FIG. 5, two devices 10, 10' are to be inserted between the spine 41 of a conventional ring binder 40 and the ring mechanism 42 (See FIG. 7). The ring mechanism 42 is secured to the spine 41 by rivets 43, 44. To mount the devices 10, 10' to the ring binder 40, one pushes the devices into the ring binder along directions 46, 46', respectively. The devices 10, 10' thus are eased between the ring mechanism 42 and the spine 41 until the configuration of FIG. 6 is achieved. With the devices 10, 10' now mounted to the ring binder 40, the ring binder can be placed in a hanging file by dropping it between the parallel, horizontal support rails 47, 48 of the hanging file system. As shown in FIG. 6, the horizontal support rails 47, 48 support the devices 10, 10', which devices in turn support the ring binder 40. This manner of supporting binders in a hanging file has the advantage of allowing the contents of the ring binder to hang from the rings without interference from any other structure, as well as allowing the front and back covers of the ring binder also to hang unimpeded.

To remove the devices 10, 10' from the ring binder 40, one simply grasps the end portions 26 of each of the devices and pulls outwardly, in the direction opposite to direction arrows 46, 46'. This withdraws the devices from between the spine of the ring binder and the ring mechanism of the ring binder. To prevent the devices from becoming accidentally or unintentionally removed or unmounted from the ring binder, the projections 21, 22 provide some gripping action when the devices are inserted between the spine and the ring mechanism. Since the space between the ring mechanism and the spine is quite limited, the raised projections tend to dig into the inside of the spine somewhat, thereby providing some limited amount of gripping force.

The present invention thus provides an easy and convenient means for converting an ordinary ring binder for hanging in a hanging file without modifying the structure of the ring binder and without requiring that the ring binder be opened up (and thereby raising the possibility that contents of the ring binder might become lost or get out of order). The present invention is also quite elegant and simple in approach in comparison with devices in the known prior art. Also, the devices according to the present invention do not contact the contents of the ring binder in any way and therefore would not damage the same. Also, devices according to the present invention are easily and readily removably mounted to the ring binder and can be used with a wide range of sizes of existing, conventional ring binders.

While the invention has been described in preferred forms only, it will be obvious to those skilled in the art that many modifications, additions, and deletions may be made therein without departing from the spirit and scope of the invention as set forth in the following claims.

I claim:

1. A device for supporting a ring binder vertically within a hanging filing system of the type having laterally extending support rails, the ring binder of the type having a spine and a ring mechanism secured to the spine by two or more fasteners, said device comprising:

a thin, generally U-shaped support bracket adapted to be removably inserted between the spine of the ring binder and the ring mechanism of the ring binder, said U-shaped support bracket having a medial portion and first and second elongate arms extending from said medial portion and spaced apart from one another, said elongate arms defining an opening therebetween sized and adapted to receive one of the fasteners therein, said medial portion being sized and adapted so that with said elongate arms inserted between the spine and the ring mechanism said medial portion is positioned at least partly beyond an edge of the spine for resting atop one of the support rails of the filing system.

2. A device as claimed in claim 1 wherein said medial portion generally defines a plane and wherein said support bracket further comprises securing means for preventing said support bracket from slipping off and beneath the support rail of the filing system, said securing means comprising an end portion of said bracket which extends transversely to said plane.

3. A device as claimed in claim 1 further comprising gripping means associated with said elongate arms for releasably retaining said elongate arms between the spine and the ring mechanism.

4. A device as claimed in claim 3 wherein said elongate arms are generally planar and wherein said gripping means comprises at least one raised surface formed in one of said elongate arms.

5. A device as claimed in claim 3 wherein said gripping means comprises first and second projections positioned along said first and second elongate arms, respectively.

6. A device as claimed in claim 1 wherein said medial portion generally defines a plane and wherein said support bracket further comprises securing means for preventing said support bracket from slipping off and beneath the support rod of the filing system, said device further comprising gripping means associated with said elongate arms for releasably retaining said elongate arms between the spine and the ring mechanism.

7. A device as claimed in claim 6 wherein said gripping means comprises at least one projection positioned along at least one of said elongate arms.

8. A device as claimed in claim 1 wherein said elongate arms have tapered end portions distal said medial portion for easing insertion of said elongate arms between the spine and the ring mechanism.

9. A device as claimed in claim 1 wherein said support bracket further comprises a hook-like portion for releasably securing said support bracket atop one of the support rails of the filing system.

* * * * *